United States Patent [19]

Street

[11] 4,037,355

[45] July 26, 1977

[54] MARBLE TRACK TOY

[76] Inventor: Bonnie A. Street, Rte. 2, Box 8, McEwen, Tenn. 37101

[21] Appl. No.: 715,872

[22] Filed: Aug. 19, 1976

[51] Int. Cl.[2] ..... A63H 33/00

[52] U.S. Cl. ..... 46/43

[58] Field of Search ..... 46/43; 273/474

[56] References Cited

U.S. PATENT DOCUMENTS

| | | | |
|---|---|---|---|
| 1,388,059 | 8/1921 | Richman | 46/43 |
| 1,739,719 | 12/1929 | Sunderman | 46/43 |
| 2,558,881 | 7/1951 | Scharkoff | 46/43 |

*Primary Examiner*—Louis G. Mancene
*Assistant Examiner*—Robert F. Cutting
*Attorney, Agent, or Firm*—Harrington A. Lackey

[57] ABSTRACT

A marble toy incorporating an inclined magazine trough having a seat opening therein for receiving one marble at a time in a stationary position, a plurality of tracks below the seat opening for guiding a marble by gravity to drop upon a teeter arm for actuating a plunger device cooperating with the seat opening for releasing one marble at a time to roll upon the tracks.

7 Claims, 3 Drawing Figures

10
11
12
13
14
15
16
20
21
22
22'
23
25
27
28
29
30
32
33
35
36
37
38
39
40
41
43
44
45
46
47
2
3

10
11
13
14
15
16
20
22
27
28
29
30
32
33
35
36
37
38
39
40
41
43
44
45
46

20
22'
25
43
44
45
46
47

MARBLE TRACK TOY

BACKGROUND OF THE INVENTION

This invention relates to a marble track toy, and more particularly to a marble track toy having an automatic marble feeding apparatus.

Marble track toys are well-known in the art, as well as automatic marble release mechanisms for feeding one marble at a time after a marble has run its course down the track.

Nevertheless, it is not believed that a marble track toy has been devised including a plunger-type of marble release mechanism actuated by a marble dropping upon a teeter arm cooperatively associated with the plunger mechanism.

SUMMARY OF THE INVENTION

It is therefore an object of this invention to provide a marble track toy having an improved automatic marble feeding or release mechanism actuated by a marble which has run its course down the track or chute.

More specifically, this marble track toy includes a plunger-type of marble release mechanism for discharging one marble at a time and a teeter arm operated by the kinetic energy of a falling marble for actuating the plunger release mechanism.

The plunger release mechanism includes a vertical plunger tube depending from a seat opening in a magazine trough, a marble being adapted to rest in a stationary position upon the seat opening. A plunger element adapted to reciprocate vertically within the plunger tube operatively engages or rests upon one end of a teeter arm. The plunger element moves upward to discharge the marble from the seat opening upon the depression of the opposite end of the teeter arm by another falling marble from the track element upon which the marble rolls from the magazine trough.

DESCRIPTION OF THE PREFERRED EMBODIMENT

Figure 1:
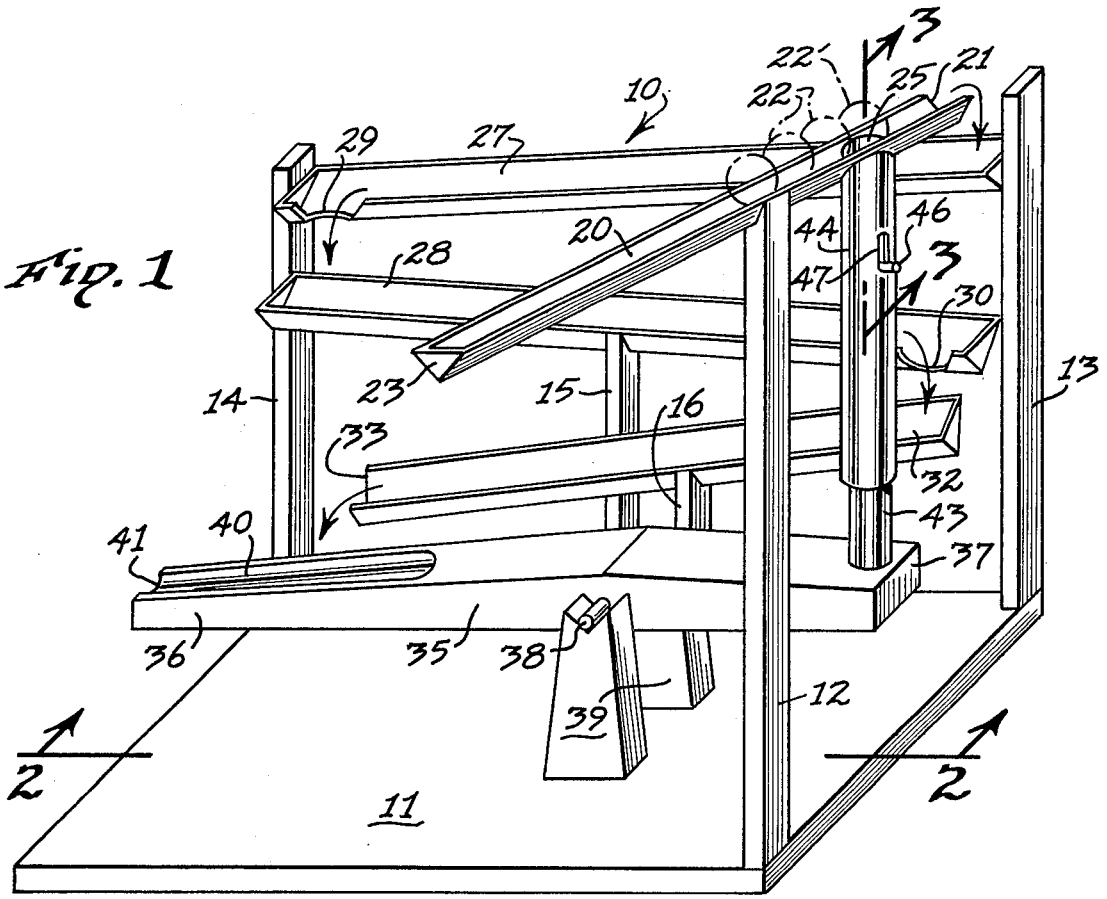
FIG. 1 is a perspective view of the marble track toy made in accordance with this invention.

Referring now to the drawings in more detail, the toy 10 includes a base 11 having a plurality of vertical upright support members or posts 12, 13, 14, 15 and 16.

Fixed upon the top of the upright support member 12 is an elongated declining magazine trough 20 having an open lower or discharge end 21. The magazine trough 20 is designed to receive, in series, a plurality of rolling or spherical objects, such as the marbles 22. The trough declines from its closed end 23 toward its open end 21 sufficiently to permit the spherical objects 22 to roll by gravity down the inclined trough 20.

Spaced upward from the open end 21 and formed through the bottom of the trough 20 is a seat opening or hole 25 having a diameter less than the diameter of any of the marbles 22, so that a marble 22 may rest in a stationary position within the seat opening 25.

Spaced vertically below the open end 21 of the magazine trough 20 is an upper declining track member or chute 27. The upper end portion of the track member 27 is fixed to the upright support member 13, while the lower end of the track member 27 is fixed to the support member 14. The upper end portion of the track member 27 is adapted to receive the marble 22 dropping from the open end 21 of the trough 20, so that the marble 22 will roll down the track member 27.

Also mounted upon the upright support members 13 and 14 is a second or intermediate track member or chute 28 spaced below the upper track member 27, but declining in the opposite direction. Thus, the upper end portion of the track member 28 is fixed to the support member 14 immediately below the lower end of the track member 27 so that a marble 22 gravitating toward the lower end of the track member 27 will drop over the recess or slot 29, in the lower end of the track member 27, upon the upper end portion of the track member 28. The lower end of the track member 28 is also provided with a discharge recess or slot 30 through which the marble 22 will drop to the upper end of a lower or third track member 32 mounted upon the support member 16 so that it declines in the opposite direction from the track member 28 and terminates in an open end 33.

Spaced below the open end 33 of the lower track member 32 is a teeter arm 35 having a first end portion 36 and an opposite, second end portion 37. Projecting from opposite sides of the middle portion of the teeter arm 35 are the opposite ends of a pintle 38 pivotally supported upon a pair of standards, trunnions or pillow blocks 39 fixed to the base 11. Thus, the teeter arm 35 is free to pivot upon the standards 39 about the horizontal transverse axis of the pintle 38. The first end portion 36 is provided with an elongated recessed guide surface for receiving a marble 22 dropping vertically from the free end 33 of the lower track member 32, and for directing or routing the marble downward over the free end 41 of the guide recess 40. A marble 22 dropping from the free end 33 will automatically depress the first end portion 36 by virtue of its gravitational force to lift the opposite end portion 37. Engaging the top surface of the opposite end portion 37 is a plunger element including a vertical plunger 43 freely reciprocating vertically within a vertical hollow plunger tube 44. The vertical tube 44 is stationarily fixed to the bottom of the trough member 20 and in vertical registry with the seat opening 25.

The plunger element also includes a vertically reciprocal cylindrical ram 45 adapted to vertically reciprocate within the hollow tube 44, but only to a limited degree by virtue of the radial stop pins 46 extending through the vertical elongated guide slots 47 within the stationary tube 44. The size and positioning of the ram 45 are such that when the ram 45 is in its upper extreme position determined by the location of the stop pins 46 in the upper ends of the guide slots 47, the upper end of the ram 45 will project upward through the seat opening 25 to elevate and release a marble 22 received in the seat opening 25, and permit the released marble 22 to roll down the lower portion of the trough 20 until it drops upon the upper portion of the upper track member 27.

To operate the toy 10, preferably a plurality of marbles 22 are placed upon the trough member 20 serially in longitudinal alignment above the seat opening 25. The marbles 22 are then permitted to slowly gravitate until the lowermost, or front, marble 22' comes to rest in the seat opening 25. Then, all the marbles 22 behind the stationary marble 22' will also come to rest, and remain stationary until the front marble 22' is released from the seat opening 25. Also, in the initial position, the weight of the plunger 43 upon the end portion 37 will depress the end portion 37 and force upward the end portion 36 of the teeter arm 35. Simultaneously, the ram 45 will rest in its lower position by virtue of the stop pins 46 resting in the lower end portions of the guide slots 47, so that the top end of the ram 45 will be below the seat opening 25 as well as clearing the front marble 22' seated in the seat opening 25.

Figure 2:
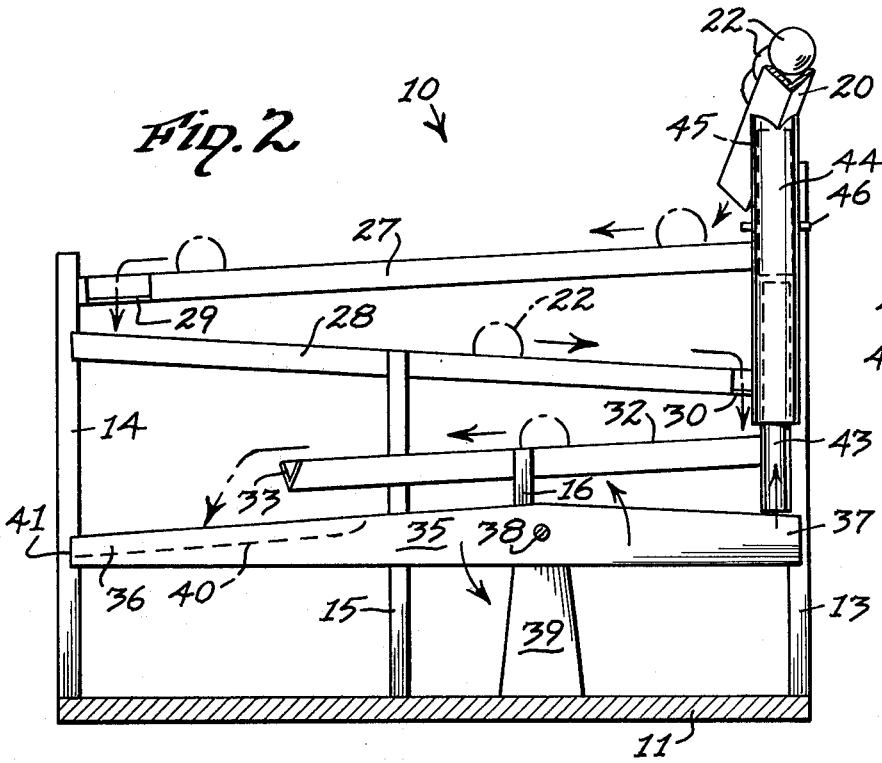
FIG. 2 is a section taken along the line 2—2 of FIG. 1 showing the path of the marble.

In order to start the operation of the toy 10, another marble 22 may be dropped upon the upper track member 27. The marble 22 rolls down the track member 27 until it falls over the recess 29 upon the next lower track member 28, as disclosed in FIG. 2. The ball continues rolling down the track 28 until it falls through the open slot 30 upon the lowermost track member 32. The marble 22 continues down the track member 32 and over the open end 33, falling with sufficient force upon the free end portion 36 of the teeter arm 35 to cause the opposite end portion 37 to rise rapidly, thrusting upward the plunger 43 within the plunger tube 44.

The rapidly rising plunger 43 engages and forces upward the ram 45 to strike and eject the marble 22' from the seat opening 25, thereby causing the unseated marble 22' to continue down the trough member 20, over the open end 21 and upon the track member 27. The marble 22' then repeats the cycle of the previous marble 22, continuing down the successive track members 27, 28 and 32 to again drop upon the teeter arm 35 and actuate the plunger mechanism 43-45 to eject the next successive marble.

As each marble 22' is ejected from the seat opening 25, the next successive marble 22 gravitates down the trough 20 until it becomes seated in a stationary position upon the seat opening 25.

As each marble 22 drops from the free open 33 of the lowermost track member 32, it is received in the guide recess 40. When the free end portion 36 is depressed by the falling marble 33 to a declining position, the marble in the recess 40 rolls longitudinally outward over the open end 41, where it is stored in a convenient receptacle, not shown, if desired, or picked up and placed in the upper end portion of the trough 20 behind the series of stored marbles 22.

Figure 3:
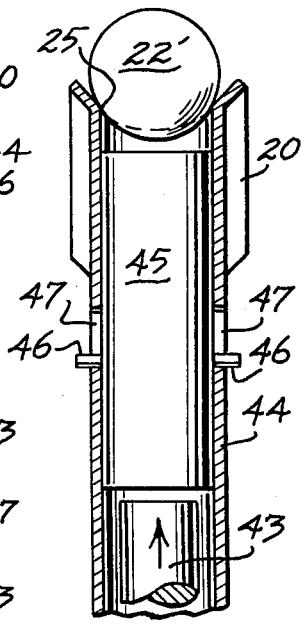
FIG. 3 is an enlarged fragmentary section taken along the line 3—3 of FIG. 1 disclosing the plunger release mechanism in its inoperative position.

Once the marble 22' is forcibly ejected from the seat opening 25, the weight of the ram 45 will cause it to drop back to its inoperative position disclosed in FIG. 3, and the weight of the plunger 43, after spending its kinetic energy in its upward thrust against the ram 45, will also force downward the end portion 37 to raise the free end portion 36 to its original, inoperative position for receiving the next marble over the free end 33 of the track member 32.

Thus, once the operation is manually started by causing the first marble 22 to roll down the series of tracks and fall upon the teeter arm 35, the releasing operation of the plunger mechanism 43 and 45 becomes automatic, releasing one marble at a time, and actuating the release mechanism each time a marble has run its course down the last track member 32 to actuate the teeter arm 35.

What is claimed is:

1. A marble track toy comprising:

a. a base, b. a declining magazine trough mounted on said base for supporting a plurality of rolling objects.

c. a seat opening in said magazine trough for receiving by gravity one of said rolling objects in a stationary position, d. declining track means on said base below said seat opening having a lower end, and along which said rolling objects are adapted to roll, e. said track means being adapted to receive a rolling object released from said seat opening, f. a teeter arm having first and second end portions, g. fulcrum means mounting said teeter arm on said base to pivot about a horizontal transverse axis between said end portions, said first end portion being vertically below the lower end of said track means, h. plunger means operatively associated with said second end portion and cooperative with said seat opening to release a rolling object from said seat opening to cause said object to roll toward and upon said track means when another rolling object drops from the lower end of said track means upon the first end portion of said teeter arm.

2. The invention according to claim 1 in which said plunger means comprises a vertical tube communicating with said seat opening and a plunger element reciprocably received within said tube for elevating a rolling object received in said seat opening when said plunger element moves upward within said tube.

3. The invention according to claim 2 in which said tube is in vertical alignment with the second end portion of said teeter arm, the lower portion of said plunger element engaging said second end portion for vertical movement therewith.

4. The invention according to claim 3 in which said plunger element comprises a lower plunger engaging the second end portion of said teeter arm and freely vertically reciprocal within said hollow tube, said plunger element further comprising a reciprocal ram above said plunger mounted in the upper portion of said vertical tube for limited reciprocal movement, said ram being adapted to elevate and release a rolling object from said seat opening when said ram is raised by said plunger.

5. The invention according to claim 1 in which the first end portion of said teeter arm comprises guide means for routing a rolling object received from the free end of said track means along said teeter arm.

6. The invention according to claim 1 in which said magazine trough is adapted to receive a plurality of rolling objects in series above said seat opening, said magazine trough further comprising an open end below said seat opening vertically spaced above said track means.

7. The invention according to claim 6 in which said track means comprises a plurality of declining chutes having upper and lower ends arranged to permit continuous rolling of said rolling objects sequentially down said chutes to the lower end of said track means.

* * * * *